US009579807B2

(12) United States Patent
Chu et al.

(10) Patent No.: US 9,579,807 B2
(45) Date of Patent: Feb. 28, 2017

(54) FOLDABLE KNIFE WITH MULTIPLE SWITCHING MODES

(71) Applicants: Hui-Tung Chu, New Taipei (TW); Jiun-Yu Chu, New Taipei (TW)

(72) Inventors: Hui-Tung Chu, New Taipei (TW); Jiun-Yu Chu, New Taipei (TW)

( * ) Notice: Subject to any disclaimer, the term of this patent is extended or adjusted under 35 U.S.C. 154(b) by 165 days.

(21) Appl. No.: 14/464,972

(22) Filed: Aug. 21, 2014

(65) Prior Publication Data

US 2016/0052151 A1 Feb. 25, 2016

(51) Int. Cl.
*B26B 1/04* (2006.01)

(52) U.S. Cl.
CPC ..... *B26B 1/04* (2013.01)

(58) Field of Classification Search
CPC ..... B26B 1/04; B26B 1/00; B26B 1/02; B26B 1/042; B26B 1/048
See application file for complete search history.

(56) References Cited

U.S. PATENT DOCUMENTS 8,046,923 B2 * 11/2011 Liu ..... B26B 1/02 30/160
2005/0172497 A1 * 8/2005 Linn ..... B26B 1/02 30/161
2006/0272158 A1 * 12/2006 Williams ..... B26B 1/044 30/161
2012/0144677 A1 * 6/2012 Chang ..... B26B 1/044 30/161

* cited by examiner

*Primary Examiner* — Jonathan Riley
*Assistant Examiner* — Liang Dong
(74) *Attorney, Agent, or Firm* — patenttm.us

(57) ABSTRACT

A foldable knife with multiple switching modes comprises a knife handle, a blade and a switch device. The knife handle has a resisting elastic plate, a positioning plate and a top cover. The resisting elastic plate has an elastic portion. The positioning plate is connected to the resisting elastic plate and has an elastic arm extended in the positioning plate. The top cover is mounted on the positioning plate and has a slide slot. The slide slot is formed on the top cover. The blade has a pressing rod and a manual pushing rod which are respectively formed on a surface of the blade towards the positioning plate. The switch device is mounted in the slide slot and has a pushing block mounted through the top cover, and the switch device is used to switch between an assisted opening mode and a manual opening mode.

6 Claims, 6 Drawing Sheets

FOLDABLE KNIFE WITH MULTIPLE SWITCHING MODES

BACKGROUND OF THE INVENTION

1. Field of the Invention

The present invention relates to a folding knife, especially a foldable knife with multiple switching modes.

2. Description of the Prior Arts

A conventional folding knife is a portable cutter. The conventional folding knife includes two types, one is manual folding knife and the other one is assisted folding knife. The manual folding knife has a knife handle and a blade mounted pivotally in the knife handle. When using the manual folding knife, a user needs to apply a continuous force for pushing the blade to a fixed position. Therefore, the manual folding knife is safe in carrying and opening. But opening the manual folding knife is slow and requires more physical force, so the manual folding knife is not suitable for use in emergency.

Furthermore, the assisted folding knife has a knife handle and a blade mounted pivotally in the knife handle. There is usually a spring element connecting to the blade and the knife handle. When the blade rotates into the knife handle, the spring element is compressed and elastically deformed by the blade. And the blade is positioned in the knife handle. When opening the blade, the user can only apply a small force to overcome the detent mechanism that holds the blade closed and then the blade would quickly pop out the rest of the way to the release the locked position by the spring element. Thus the assisted folding knife has the advantage of quickly opening the blade when needed. However, the advantage of the assisted folding knife might increase the danger when using the assisted folding knife, because the blade of the assisted folding knife is easily opened and increases the risks of unintentionally popping out. Especially, the assisted folding knife is dangerous when carried in the pocket.

To overcome the shortcomings, the present invention provides a foldable knife with multiple switching modes to mitigate or obviate the aforementioned problems.

SUMMARY OF THE INVENTION

The main objective of the present invention is to provide a foldable knife with multiple switching modes including an assisted opening mode and a manual opening mode, so that the present invention has both safety and promptness by switching between different opening modes.

A foldable knife with multiple switching modes comprises a knife handle, a blade and a switch device.

The knife handle has a resisting elastic plate, a positioning plate, a top cover and a rotary shaft. The resisting elastic plate has a first rotary hole formed through the resisting elastic plate and an elastic portion formed in the resisting elastic plate, and the resisting elastic plate is a curved plate. The positioning plate is connected to the resisting elastic plate with an interval between the positioning plate and the resisting elastic plate and has a second rotary hole and an elastic arm. The second rotary hole is formed through the positioning plate and corresponds to the first rotary hole of the resisting elastic plate. The elastic arm is movably extended in the positioning plate. The top cover is mounted on the positioning plate and has a through hole and a slide slot. The through hole is formed through the top cover and corresponds to the second rotary hole of the positioning plate. The slide slot is formed on an inner surface of the top cover. The rotary shaft is mounted pivotally through the first rotary hole, the second hole and the through hole.

The blade is mounted pivotally between the resisting elastic plate and the positioning plate and is mounted through by the rotary shaft. The blade has a pressing rod and a manual pushing rod which are respectively formed on a surface of the blade towards the positioning plate.

The switch device is mounted movably in the slide slot of the top cover and has a pushing block formed on the switch device and mounted through the top cover, the switch device is used to switch between an assisted opening mode and a manual opening mode.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
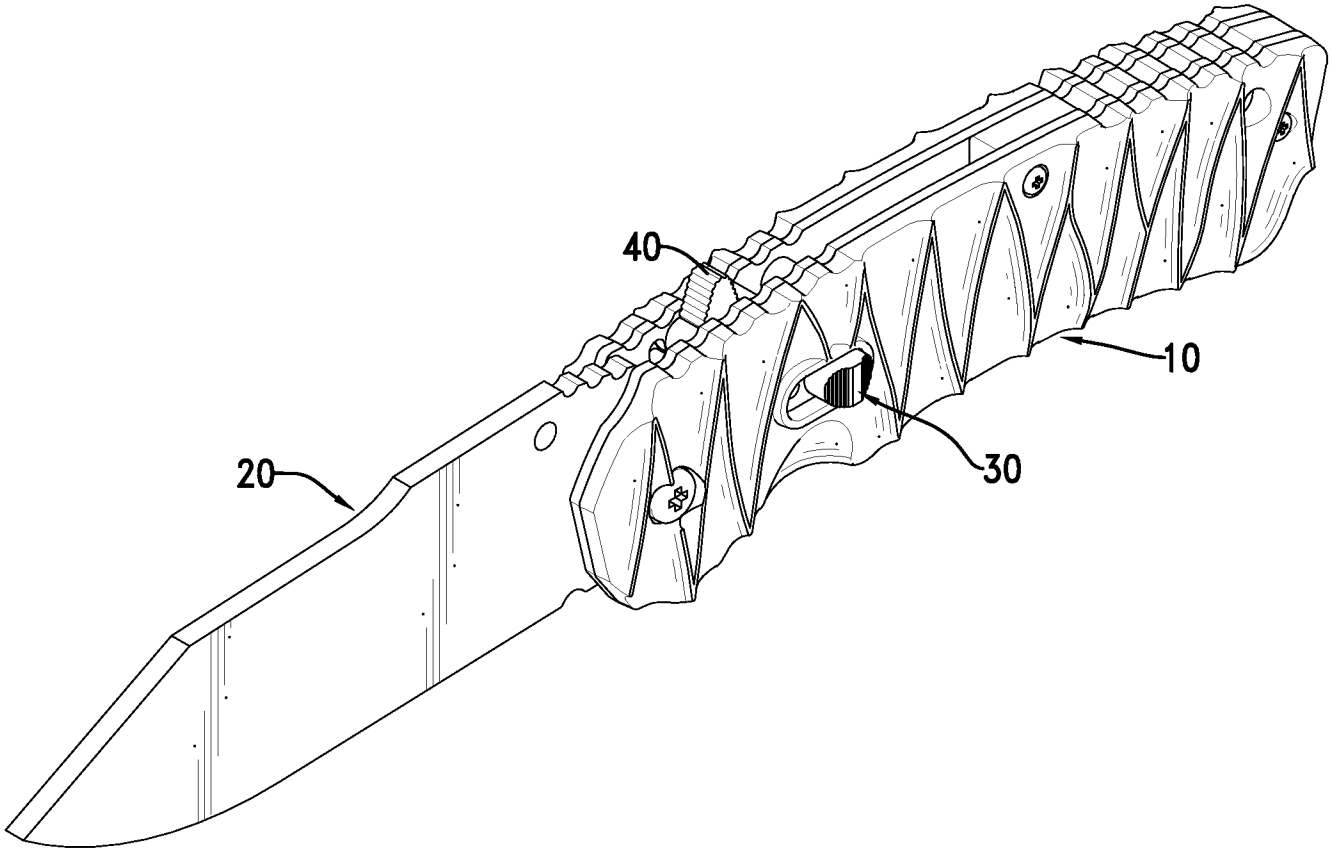
FIG. 1 is a perspective view of a foldable knife with multiple switching modes in accordance with the present invention.

With reference to FIG. 1, a foldable knife with multiple switching modes in accordance with the present invention has a knife handle 10, a blade 20 and a switch device 30.

Figure 2:
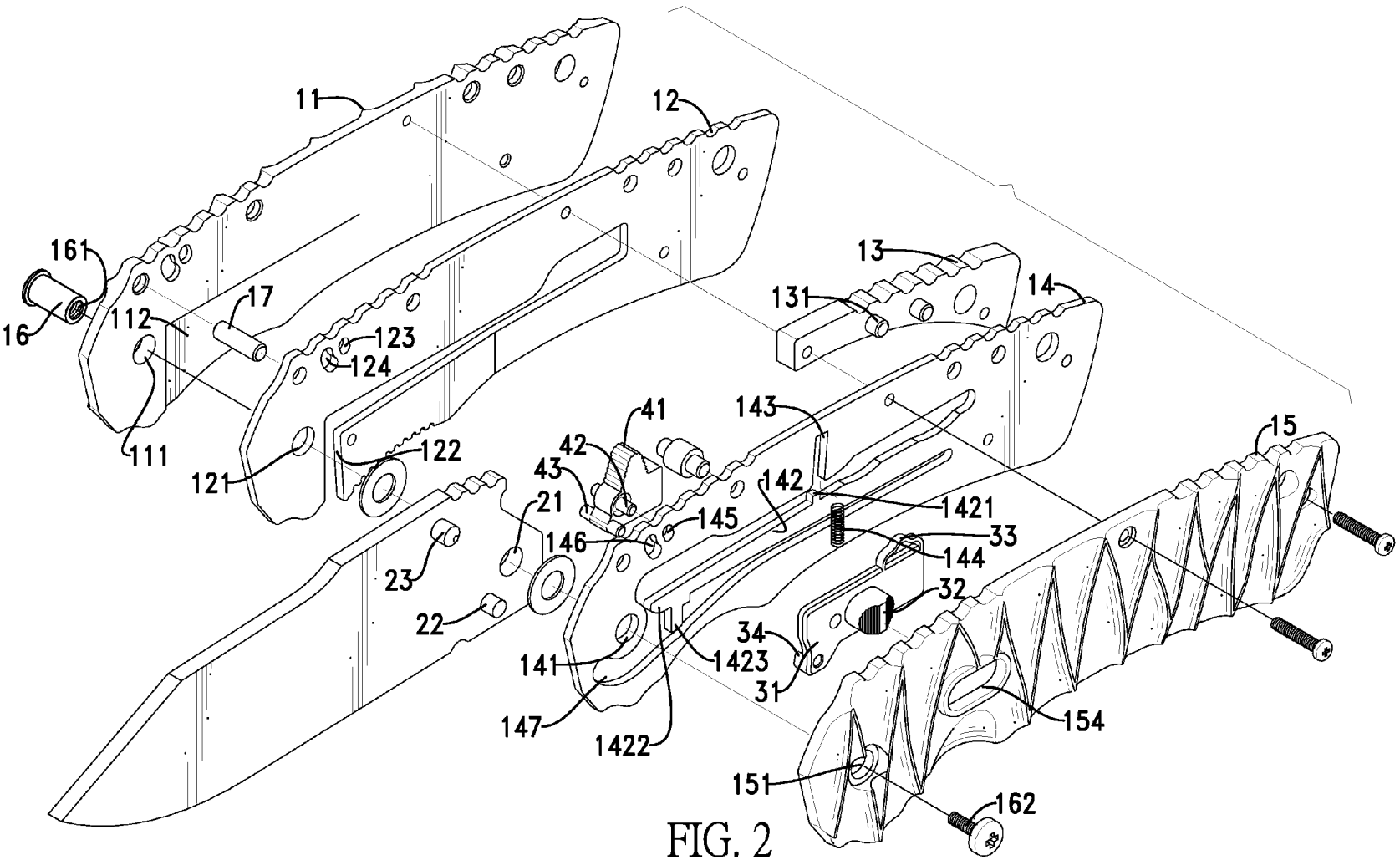
FIG. 2 is an exploded perspective view of the foldable knife with multiple switching modes in FIG. 1.
Figure 3:
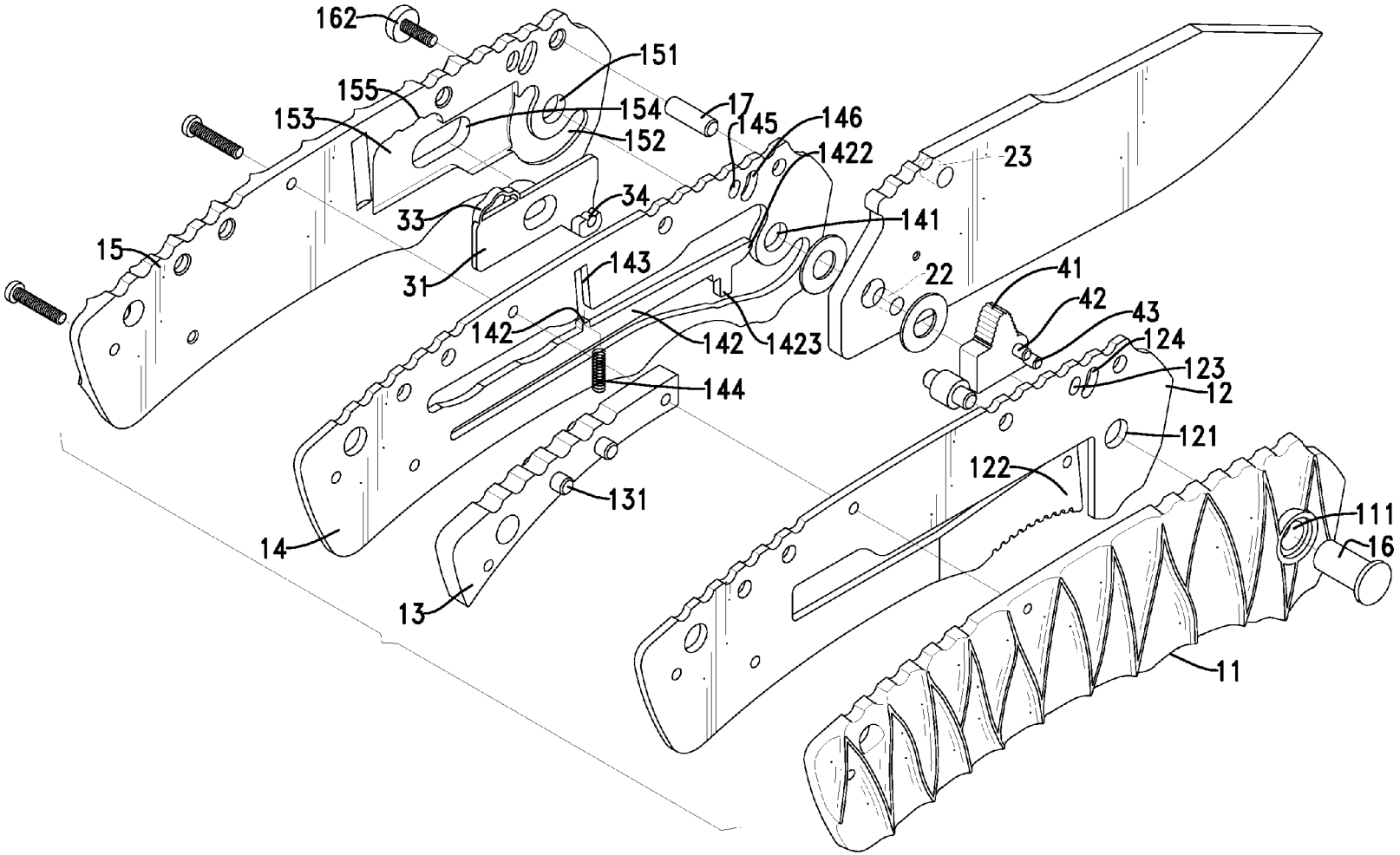
FIG. 3 is another exploded perspective view of the foldable knife with multiple switching modes in FIG. 1.

With reference to FIGS. 1 to 3, the knife handle 10 has a bottom cover 11, a resisting elastic plate 12, a connecting bar 13, a positioning plate 14, a top cover 15, a rotary shaft 16 and a positioning rod 17.

The bottom cover 11 has a front end, an inner surface, a rotary hole 111 and a shallow groove 112. The rotary hole 111 is formed through the front end of the bottom cover 11 and the shallow groove 112 is formed gradually inclined on the inner surface of the bottom cover 11 towards the rotary hole 111. The resisting elastic plate 12 is mounted on the inner surface of the bottom cover 11 and has a first rotary hole 121 and an elastic portion 122. The first rotary hole 121 is formed through the resisting elastic plate 12 and corresponds to the rotary hole 111 of the bottom cover 11. The elastic portion 122 is formed with the resisting elastic plate 12 and is distal from the inner surface of the bottom plate 11, and the elastic portion 122 is a curved plate that can be deformed by pressing. In a preferred embodiment, the resisting elastic plate 12 has a first pivot hole 123 and a first moving hole 124 which are formed through the resisting elastic plate 12 and are at an interval with the first rotary hole 121. The first moving hole 124 is a curved hole.

The connecting bar 13 is mounted on a side surface of the resisting elastic plate 12 distal from the bottom cover 11. The connecting bar 13 has multiple cylinders 131. The cylinders 131 respectively extend from two opposite outer surfaces of the connecting bar 13. The cylinders 131 that extend from one of the opposite outer surfaces of the connecting bar 13 are mounted through the resisting elastic plate 12 and are mounted in the inner surface of the bottom cover 11.

The positioning plate 14 is connected to the connecting bar 13 and faces the resisting elastic plate 12 with an interval between the positioning plate 14 and the connecting bar 13. The positioning plate 14 is mounted through by the cylinders 131 of the other opposite outer surface of the connecting bar 13. The positioning plate 14 has a second rotary hole 141, a space 147, an elastic arm 142, a holding groove 143 and a spring 144. The second rotary hole 141 is formed through the positioning plate 14 and corresponds to the first rotary hole 121 of the resisting elastic plate 12. The space 147 is formed through the positioning plate 14 and adjacent to the second rotary hole 141.

The elastic arm 142 is movably extended in the positioning plate 14 and has a top surface, a bottom surface, a positioning portion 1421, a pressing portion 1422 and a switching portion 1423. The positioning portion 1421 is formed on a middle part of the top surface of the elastic arm 142. The pressing portion 1422 is formed on an end of the elastic arm 142 adjacent to the second rotary hole 141. The switching portion 1423 is formed on the bottom surface of the elastic arm 142 adjacent to the pressing portion 1422. The holding groove 143 is formed through the positioning plate 14 and corresponds to the positioning portion 1421. The spring 144 is mounted in the holding groove 143 and sleeved around the positioning portion 1421, and the elastic arm 142 can be moved in the space 147 relative to the holding groove 143. In a preferred embodiment, the positioning plate 14 has a second pivot hole 145 and a second moving hole 146 which are formed through the positioning plate 14. The second moving hole 146 is a curved hole. The second pivot hole 145 and the second moving hole 146 respectively correspond to the first pivot hole 123 and the first moving hole 124.

The top cover 15 is mounted on the positioning plate 14 and accommodates the cylinders 131 that extend from the other opposite outer surface of the connecting bar 13. The top cover 15 has a through hole 151, a bent slot 152, a slide slot 153, an elongated hole 154 and two engaging slots 155. The through hole 151 is formed through the top cover 15 and corresponds to the second rotary hole 141 of the positioning plate 14. The bent slot 152 is formed on an inner surface of the top cover 15 and partially surrounds the through hole 151. The slide slot 153 is formed in the inner surface of the top cover 15 and communicates with the bent slot 152, a depth of the slide slot 153 is deeper than a depth of the bent slot 152. The elongated hole 154 is formed through a middle surface of the slide slot 153 of the top cover 15. The engaging slots 155 are formed in an inner edge of the top cover 15 around the slide slot 153 and distal from the bent slot 152.

The rotary shaft 16 is mounted pivotally through the rotary hole 111, the first rotary hole 121, the second rotary hole 141, and the through hole 151 and has a screwing hole 161 and a lock component 162. The screwing hole 161 is formed in an end of the rotary shaft 16 and the lock component 162 is locked in the screwing hole 161. Multiple screws are respectively mounted through the top cover 15, the positioning plate 14, the connecting bar 13, the resisting elastic plate 12 and the bottom cover 11 for locking the foldable knife. The positioning rod 17 has two ends respectively mounted through the resisting elastic plate 12 and the positioning plate 14 and fixed in the bottom cover 11 and the top cover 15.

The blade 20 is mounted pivotally between the resisting elastic plate 12 and the positioning plate 14. The blade 20 has a blade rotary hole 21, a pressing rod 22 and a manual pushing rod 23. The blade rotary hole 21 is formed through the blade 20 and corresponds to the first rotary hole 121 and the second rotary hole 141, and the blade rotary hole 21 is mounted through by the rotary shaft 16. The pressing rod 22 is perpendicularly formed on the blade 20 towards the positioning plate 14, and the pressing rod 22 is mounted in the space 147 and an end of the pressing rod 22 is located in the bent slot 152. The manual pushing rod 23 is perpendicularly formed on the blade 20 towards the positioning plate 14 adjacent to the pressing rod 22.

The switch device 30 is mounted between the top cover 15 and the positioning plate 14. The switch device 30 has an installing plate 31, a pushing block 32, an engaging portion 33 and a limiting block 34. The installing plate 31 of the switch device 30 is mounted movably in the slide slot 153 of the top cover 15. The pushing block 32 is formed on an outer surface of the installing plate 31 and is mounted through the top cover 15. The engaging portion 33 is mounted on an outer edge of the installing plate 31 and corresponds to one of the engaging slots 155. The limiting block 34 is formed on an inner surface of the installing plate 31 and extends into the space 147 of the positioning plate 14.

In a preferred embodiment of the present invention, the present invention further has a pushing button 40 pivotally connected to the resisting elastic plate 12 and the positioning plate 14, and the pushing button 40 has a convex portion 41, a pivoting rod 42 and a swing rod 43. The convex portion 41 is formed on an outer edge of the pushing button 40 and extends over the resisting elastic plate 12 and the positioning plate 14. The pivoting rod 42 is mounted in the pushing button 40 and has two ends pivotally connected to the first pivot hole 123 and the second pivot hole 145. The swing arm 43 is mounted in the pushing button 40. The swing arm 43 has two ends movably and respectively mounted in the first moving hole 124 and the second moving hole 146.

Figure 4:
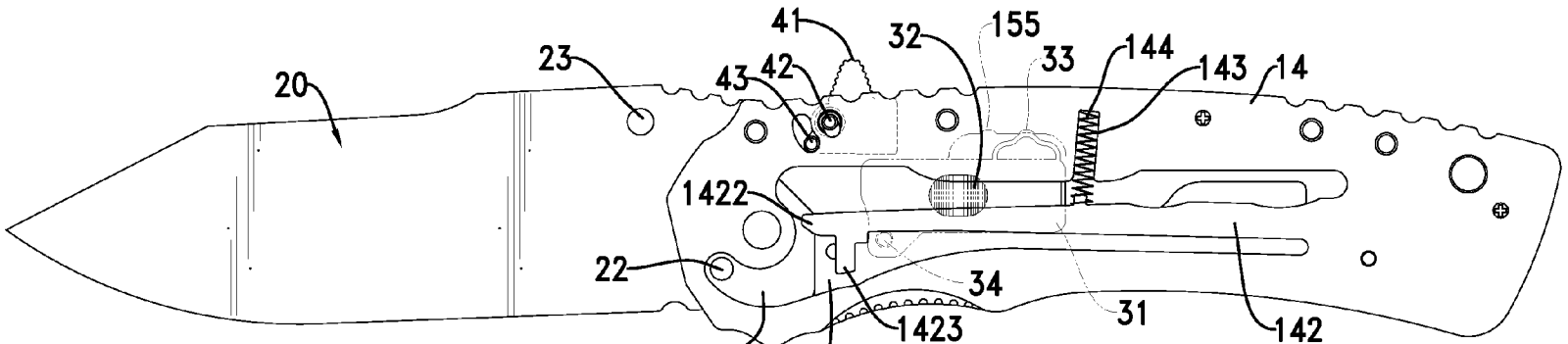
FIG. 4 is a side view in partial section of the foldable knife with multiple switching modes in FIG. 1, showing a blade under an open condition.
Figure 5:
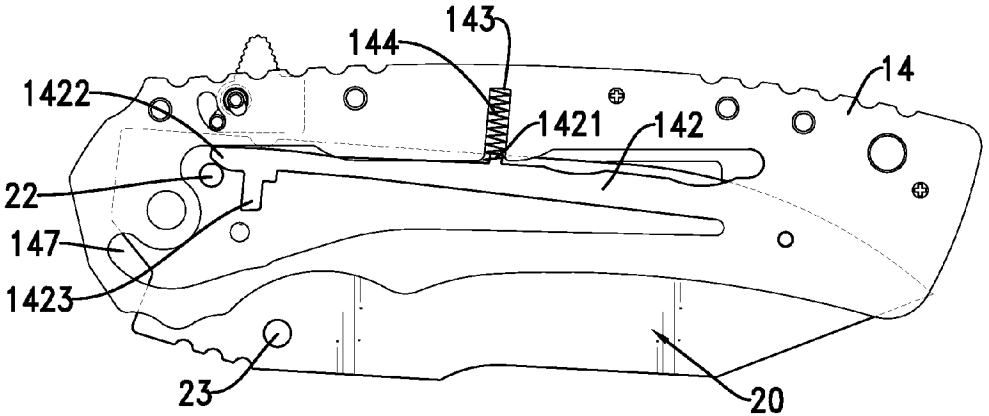
FIG. 5 is a side view in partial section of the foldable knife with multiple switching modes in FIG. 1, showing the blade under a folded condition.

With reference to FIGS. 4 and 5, the present invention has two switching modes, one is assisted opening mode and the other is manual opening mode. In the assisted opening mode, the engaging portion 33 is engaged with the engaging slot 155 that is adjacent to the holding groove 143. So the limiting block 34 does not correspond to the switching portion 1423 of the elastic arm 142. Then, turning the blade 20 towards to the knife handle 10 and the pressing rod 22 of the blade 20 pushes the pressing portion 1422, and the elastic arm 142 is forced upwardly and elastically deformed, such that the spring 144 is compressed and deformed. Finally, the blade 20 is completely retracted in the knife handle 10. When a user wants to open the blade 20, the user applies a force to the manual pushing rod 23 or the convex portion 46 to push the blade 20. After the blade 20 is continuously pushed for a distance and overcomes the binding force of the knife handle 10 that hold the blade 20 in the closed position, the blade 20 springs out to a fixed position by the recovery elasticity of the elastic arm 142 and the spring 144. At the same time, the blade 20 is securely resisted by the elastic portion 122 of the resisting elastic plate 12.

Figure 6:
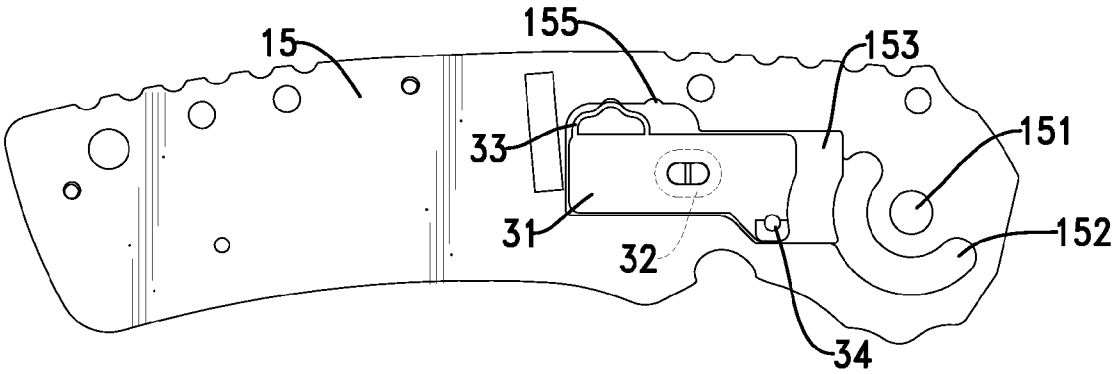
FIG. 6 is an operational view of the foldable knife with multiple switching modes in FIG. 1, showing an assisted opening mode of a switch device.
Figure 7:
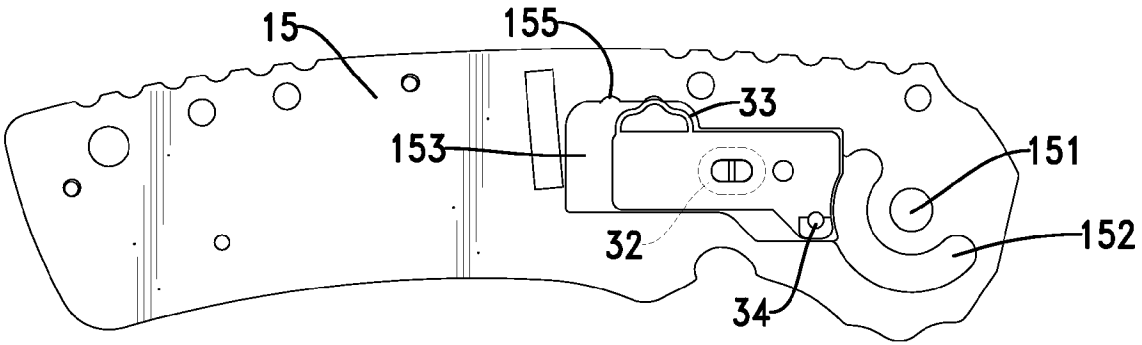
FIG. 7 is an operational view of the foldable knife with multiple switching modes, showing a manual opening mode of the switch device in FIG. 4.
Figure 8:
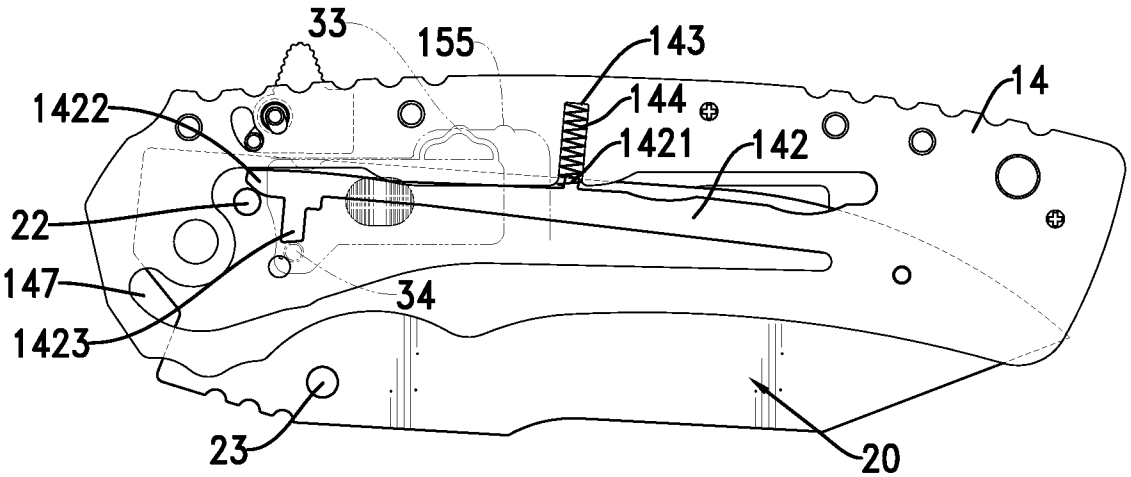
FIG. 8 is a side view in partial section of the foldable knife with multiple switching modes in FIG. 7.

In the manual opening mode, with the reference to FIGS. 6 to 8, pressing the elastic portion 122 towards to the shallow groove 112 removes the resisting connection between the elastic portion 122 and the blade 20, and turning the blade 20 towards to the knife handle 10 and the pressing rod 22 of the blade 20 pushes the pressing portion 1422, and the elastic arm 142 is forced upwardly and elastically deformed, and the spring 144 is compressed and deformed. Finally, the blade 20 is completely folded in the knife handle 10. Then by pushing the pushing block 32 of the switch device 30, the installing plate 31 is moved towards to the through hole 151. So the engaging portion 33 is engaged with the other engaging slot 155 that is away from the holding groove 143. At the moment, the limiting block 34 would correspond to and directly resist the switching portion 1423 of the elastic arm 142, and the elastic arm 142 is limited and unable to recover its elasticity. When the user wants to open the blade 20, the user has to apply a continuous force for pushing the blade 20 to the fixed position.

As the present invention has two switching modes, the user can choose to switch between the assisted opening mode and the manual opening mode, depending on different conditions and various usage habits.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A foldable knife with multiple switching modes comprising:

a knife handle having a resisting elastic plate having a first rotary hole formed through the resisting elastic plate; and an elastic portion formed in the resisting elastic plate and being a curved plate;

a positioning plate connected to the resisting elastic plate with an interval between the resisting elastic plate and the positioning plate, and having a second rotary hole formed through the positioning plate and corresponding to the first rotary hole of the resisting elastic plate;

a space formed through the positioning plate and being adjacent to the second rotary hole for the pressing rod of the blade to be mounted in the space;

an elastic arm movably extended in the positioning plate and having a top surface;

a bottom surface;

a positioning portion formed on a middle part of the top surface of the elastic arm, the positioning portion corresponding to the holding groove and sleeved on by the spring;

a pressing portion formed on an end of the elastic arm adjacent to the second rotary hole; and a switching portion formed on the bottom surface of the elastic arm adjacent to the pressing portion;

a holding groove formed through the positioning plate; and a spring mounted in the holding groove;

a top cover mounted on the positioning plate and having a through hole formed through the top cover and corresponding to the second rotary hole of the positioning plate; and a slide slot formed in an inner surface of the top cover; and a rotary shaft mounted pivotally through the first rotary hole, the second hole and the through hole;

a blade mounted pivotally between the resisting elastic plate and the positioning plate and mounted through by the rotary shaft, the blade having a pressing rod formed on a surface of the blade towards the positioning plate; and a manual pushing rod formed on the surface of the blade towards the positioning plate; and a switch device mounted movably in the slide slot of the top cover and having a pushing block formed on the switch device and mounted through the top cover, wherein, the switch device is used to switch between an assisted opening mode and a manual opening mode.

2. The foldable knife with multiple switching modes as claimed in claim 1, wherein the top cover has a bent slot formed on the inner surface of the top cover and partially surrounding the through hole, one end of the pressing rod located in the bent slot;

an elongated hole formed through a middle surface of the slide slot of the top cover; and two engaging slots formed in an inner edge of the top cover around the slide slot and distal from the bent slot;

the switch device has an installing plate mounted movably in the slide slot of the top cover;

a pushing block formed on an outer surface of the installing plate and mounted through the top cover;

an engaging portion mounted on an outer edge of the installing plate and corresponding to one of the engaging slots; and a limiting block formed on an inner surface of the installing plate and extending into the space of the positioning plate.

3. The foldable knife with multiple switching modes as claimed in claim 2, wherein the pressing rod of the blade is perpendicularly formed on the blade towards the positioning plate.

4. The foldable knife with multiple switching modes as claimed in claim 1, wherein the resisting elastic plate has a first pivot hole formed through the resisting elastic plate; and a first moving hole formed through the resisting elastic plate at an interval with the first rotary hole, the first moving hole being a curved hole;

the positioning plate has a second pivot hole formed through the positioning plate; and a second moving hole formed through the positioning plate, the second moving hole being a curved hole;

the foldable knife with switching multiple switching modes has a pushing button pivotally connected to the resisting elastic plate and the positioning plate and having a convex portion formed on an outer edge of the pushing button and extending over the resisting elastic plate and the positioning plate;

a pivoting rod mounted in the pushing button and having two ends pivotally connected to the first pivot hole and the second pivot hole; and a swing rod mounted in the pushing button and having two ends movably mounted in the first moving hole and the second moving hole.

5. The foldable knife with multiple switching modes as claimed in claim 3, wherein the resisting elastic plate has a first pivot hole formed through the resisting elastic plate; and a first moving hole formed through the resisting elastic plate and at an interval with the first rotary hole, the first moving hole being a curved hole;

the positioning plate has a second pivot hole formed through the positioning plate; and a second moving hole formed through the positioning plate, the second moving hole being a curved hole;

the foldable knife with switching multiple switching modes has a pushing button pivotally connected to the resisting elastic plate and the positioning plate and having a convex portion formed on an outer edge of the pushing button and extending over the resisting elastic plate and the positioning plate;

a pivoting rod mounted in the pushing button and having two ends pivotally connected to the first pivot hole and the second pivot hole; and a swing rod mounted in the pushing button and having two ends movably mounted in the first moving hole and the second moving hole.

6. The foldable knife with multiple switching modes as claimed in claim 2, wherein the resisting elastic plate has a first pivot hole formed through the resisting elastic plate; and a first moving hole formed through the resisting elastic plate and at an interval with the first rotary hole, the first moving hole being a curved hole;

the positioning plate has a second pivot hole formed through the positioning plate; and a second moving hole formed through the positioning plate, the second moving hole being a curved hole;

the foldable knife with switching multiple switching modes has a pushing button pivotally connected to the resisting elastic plate and the positioning plate and having a convex portion formed on an outer edge of the pushing button and extending over the resisting elastic plate and the positioning plate;

a pivoting rod mounted in the pushing button and having two ends pivotally connected to the first pivot hole and the second pivot hole; and a swing rod mounted in the pushing button and having two ends movably mounted in the first moving hole and the second moving hole.

* * * * *